United States Patent [19]

Focke et al.

[11] 4,351,142

[45] Sep. 28, 1982

[54] APPARATUS FOR WRAPPING OBJECTS, IN PARTICULAR GROUPS OF CIGARETTES

[75] Inventors: Heinz H. Focke; Kurt Liedtke, both of Verden; Hans J. Bretthauer, Bremen, all of Fed. Rep. of Germany

[73] Assignee: Focke and Company, Verden, Fed. Rep. of Germany

[21] Appl. No.: 121,856

[22] Filed: Feb. 15, 1980

[30] Foreign Application Priority Data

Feb. 17, 1979 [DE] Fed. Rep. of Germany ..... 2906204

[51] Int. Cl.[3] ..... B65B 19/24; B65B 11/08

[52] U.S. Cl. ..... 53/575; 53/228; 53/389

[58] Field of Search ..... 53/575, 228, 234, 389; 83/300, 346, 659

[56] References Cited

U.S. PATENT DOCUMENTS

| | | | |
|---|---|---|---|
| 1,110,125 | 9/1914 | Giroud | 53/575 |
| 1,320,038 | 10/1919 | De Escobales | 53/575 |
| 2,100,739 | 11/1937 | Gilfillan | 53/375 |
| 2,215,073 | 9/1940 | Roloff | 83/300 |
| 3,075,325 | 1/1963 | Liedtke | 53/228 |
| 3,274,870 | 9/1966 | Schmermund | 53/228 |
| 3,277,630 | 10/1966 | Youngman | 53/228 |
| 3,347,119 | 10/1967 | Sarka | 83/300 |
| 3,385,026 | 5/1968 | Schmermund | 53/228 |
| 3,739,545 | 6/1973 | Lattke | 53/575 |
| 3,983,578 | 9/1976 | Price | 83/346 |

*Primary Examiner*—John Sipos

*Attorney, Agent, or Firm*—Sughrue, Mion, Zinn, Macpeak & Seas

[57] ABSTRACT

A wrapping machine for U-folding a sheet of wrapping film or material around a group of cigarettes which are being conveyed along a longitudinal path to a wrapping station. The sheet of wrapping material is fed transversely into the path at the wrapping station and held there by a pair of suction rollers. Reciprocating longitudinally along the path is a receiver into which the group of cigarettes is conveyed. Before the group of cigarettes reaches the wrapping station, the forward end of the receiver engages the sheet of wrapping material and strips it from the suction rollers to form a U-shaped fold about the group of cigarettes as the group moves forwardly out of the receiver into the wrapping station. Thus, the group of cigarettes itself is not subjected to the stress required in removing the wrapping material from the suction rollers.

18 Claims, 4 Drawing Figures

APPARATUS FOR WRAPPING OBJECTS, IN PARTICULAR GROUPS OF CIGARETTES

Figure 1:
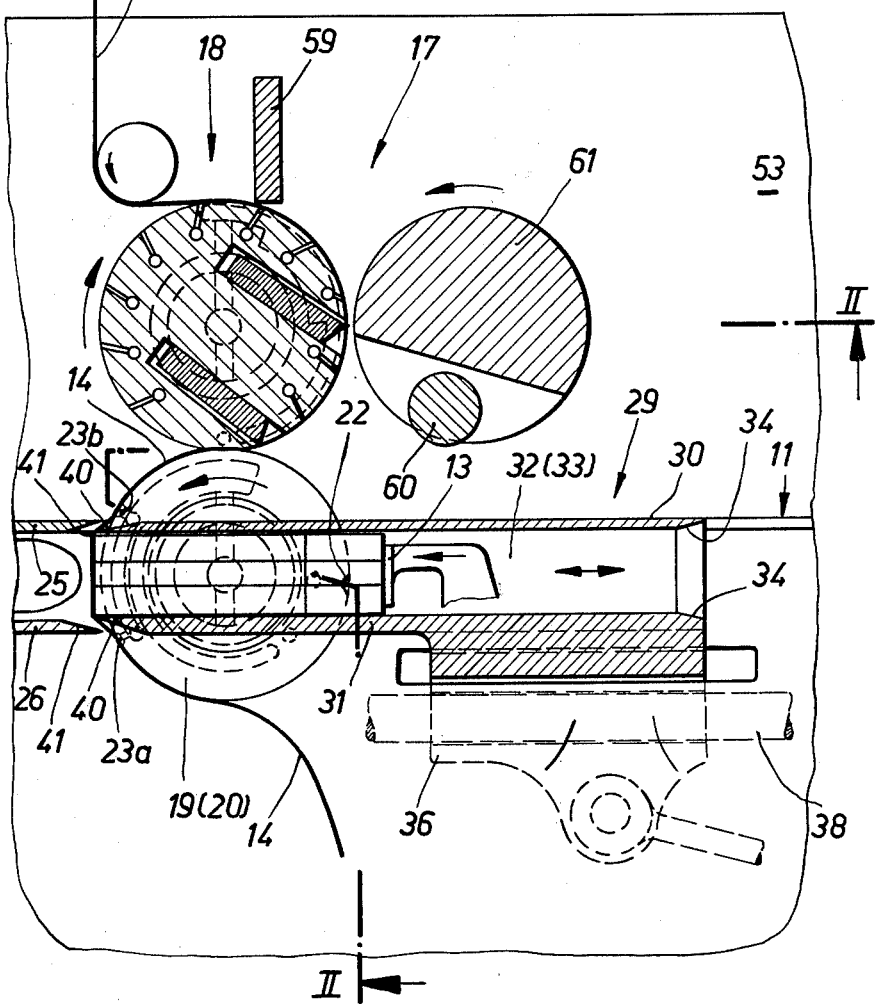

The invention relates to an apparatus for wrapping objects, in particular groups of cigarettes, in a blank or sheet of packaging material, which blank is held at least in two lateral edge zones by continuous conveyors in a plane transversely to the transport direction of the object and, being drawn off from the conveyor, can be laid in the shape of a U around the object.

The theme of the present invention is the packing of objects which are sensitive in particular to mechanical stresses, for example groups of cigarettes, which are intended for a cigarette pack. The groups of cigarettes, which on packing are fed in customarily in the longitudinal direction of the cigarettes, are wrapped frequently or predominantly by a procedure in which a blank, held ready in a plane transversely to the transport path of the cigarettes, is laid in the shape of a U around that end face of the group which is in front in the transport direction, due to the relative motion of the group.

It is a further point of the invention to hold the particular blank ready in an exact relative position and, in spite of a high output of the machine, that is to say in spite of a high conveying speed of the group of cigarettes, to lay it around the latter exactly and without creases. This should also apply to critical packaging material which, due to a low inherent stiffness, cannot be processed perfectly without continuous forced guiding.

For packaging objects which have a relatively stable shape and can be subjected to higher mechanical loads, namely finished cigarette packs, in a film of regenerated cellulose or plastic, an apparatus is known from U.S. Pat. No. 3,075,325, corresponding to German Patent Specification No. 1,169,361, wherein the blank is fixed, and held ready, by two suction pads which are applied laterally and are arranged on either side of a packaging web for the object. The revolving suction pads are provided on the periphery with suction bores which each grip a lateral edge zone of the blank. The cigarette pack is conveyed through between the suction pads and thus draws the blank off the suction pads, the wrapping forming a U-shape round the pack.

This known apparatus which is also suitable for processing, for example, a packaging material which is thin and therefore critical, entails a relatively high mechanical load on the object to be wrapped, and in particular mainly during the phase in which the blank is taken up by the front end face of the object, and during the subsequent drawing-off from the suction pads. During this initial phase, the holding force exerted by the suction pads on the blank is greatest. However, the finished cigarette packs which are to be processed in the known apparatus can absorb the loads which occur.

It is the object of the invention further to develop and to improve an apparatus of the initially stated type in such a way that objects, which are sensitive with regard to mechanical loads, in particular unpackaged groups of cigarettes, can also be wrapped without an impairment of the objects having to be accepted as a result.

According to the invention, this object is achieved by an apparatus, wherein the object—that is to say particularly the group of cigarettes—is received in a mouthpiece which, on that side of the object which is in front in the transport direction, ends flush with the object or projects slightly and by means of which the blank can, at least during an initial phase of the wrapping process, be lifted off or detached from the continuous conveyor.

Accordingly, the group of cigarettes is temporarily taken up by a receiver or support device (mouthpiece) which protects the group of cigarettes from the mechanical stresses caused by the blank taken up by the suction pads. For this purpose, the mouthpiece which preferably surrounds the group of cigarettes virtually completely in cross-section, is designed on the front side with a sharpened edge which, due to a corresponding position relative to the cigarettes, grips the blank and thus effects at the same time the initiation of an exact U folding. During this initial phase of laying the wrapping in a U-shape round the group of cigarettes the sensitive end edges of the cigarettes are protected in the external zone from the mechanical load of the blank which exerts a slight tension. Moreover, the U folding is more exact when it is laid around a solid edge.

According to a further proposal of the invention, the suction pads are provided with several groups of suction bores in locations distributed over the periphery. These suction bores grip the blank only in defined critical zones. After the blank has been taken up by the mouthpiece and afterwards by the group of cigarettes, the suction bores are disconnected from the sources of reduced pressure and are vented so that the blank can then be laid around the group of cigarettes without a retaining force due to the suction pads, while the group of cigarettes enters a subsequent receiver in the form of a mouthpiece, namely a packaging web.

Due to the suction pads, very exact feeding of the blanks at a high working speed is possible. Nevertheless, the blank is gently transferred to the group of cigarettes, without an undesirable loading of the latter.

Further features of the invention relate to the constructional design of the mouthpiece and to units upstream of the suction pads for preparing the blanks by severing them from a continuous web, and to the feeding to the suction pads.

Figure 2:
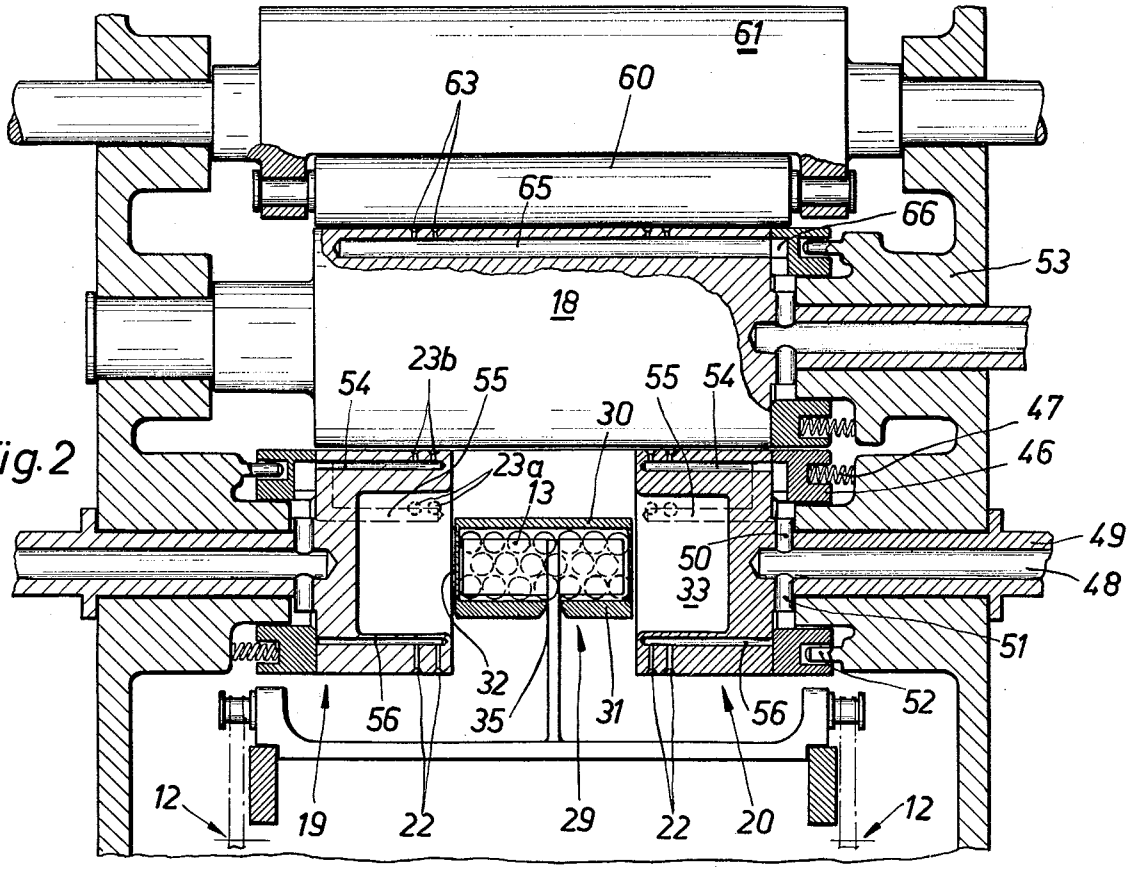
Figure 3:
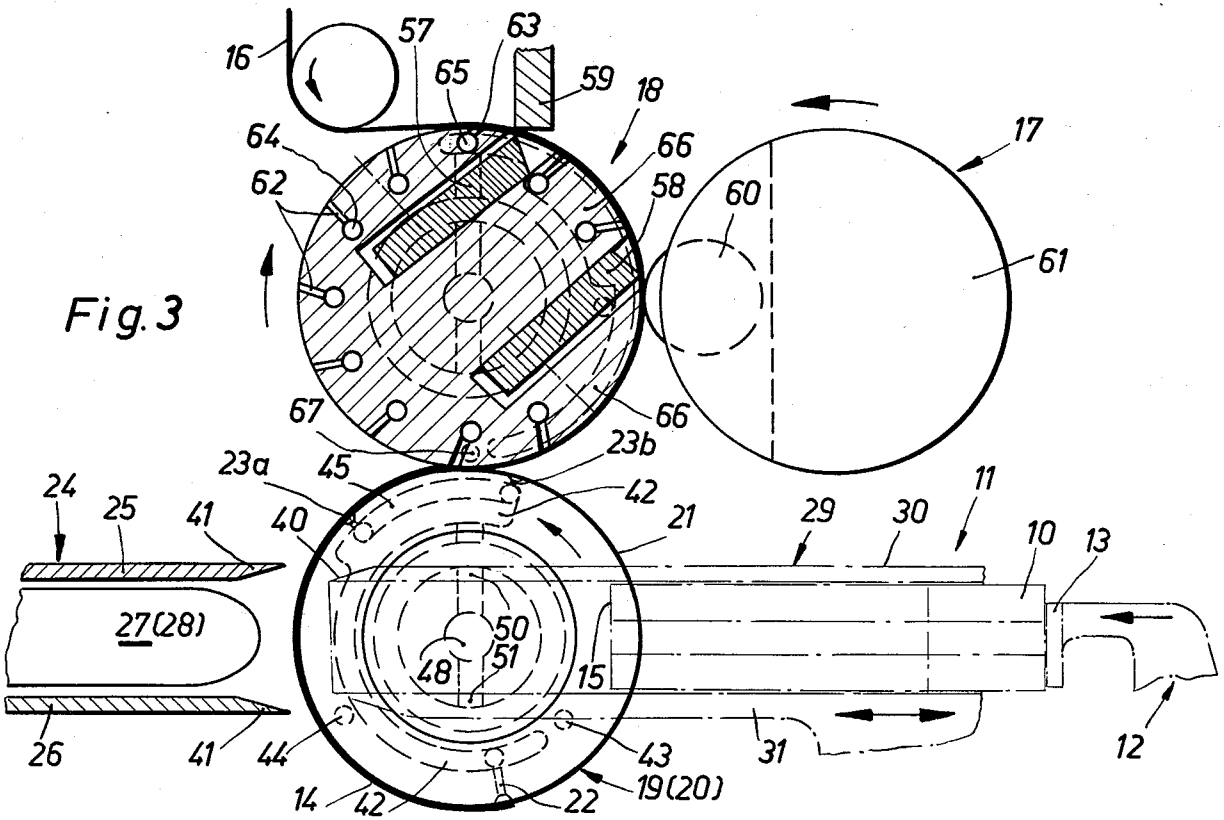
Figure 4:
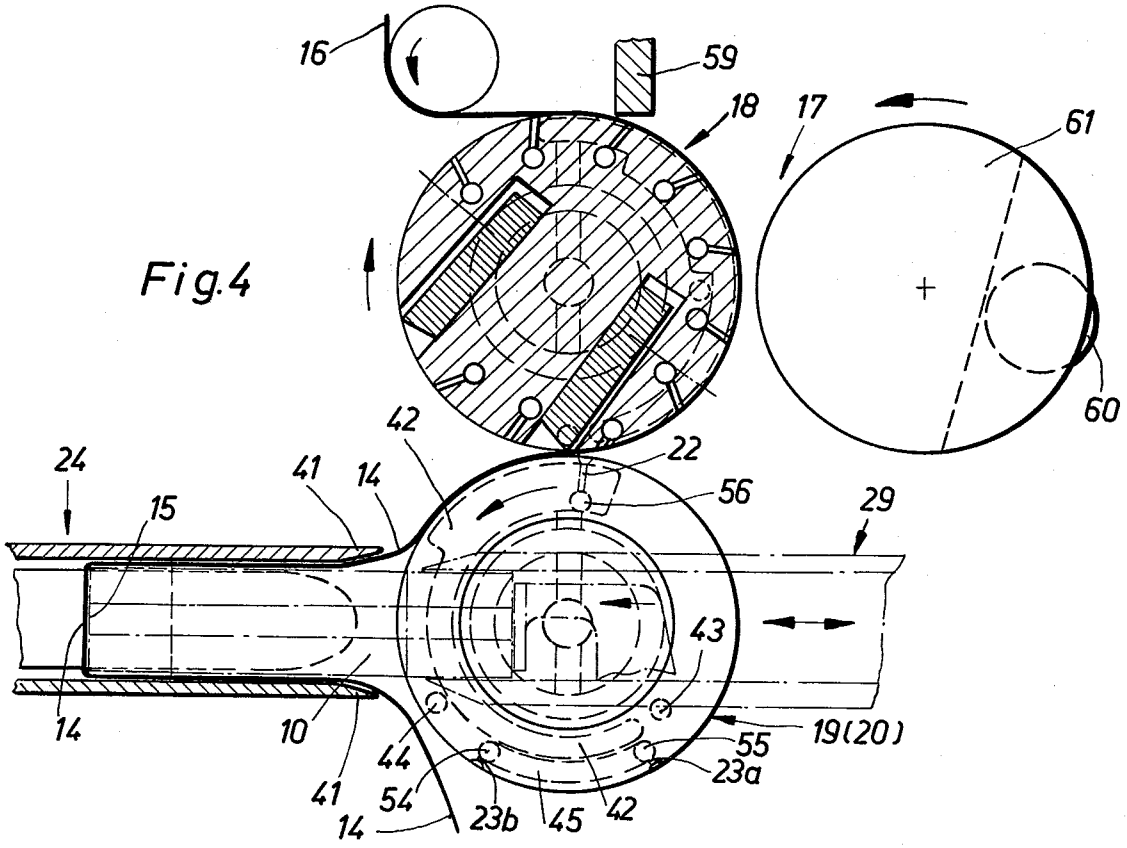

In the following text, an illustrative embodiment of the invention is explained in more detail by reference to the drawings in which:

FIG. 1 shows the part of the apparatus, of interest here, in a diagrammatic side view or in longitudinal section, FIG. 2 shows a cross-section II—II in FIG. 1, extending horizontally and vertically, FIG. 3 shows details of the apparatus in a section corresponding to FIG. 1, in a changed relative position and on an enlarged scale, and FIG. 4 shows a representation corresponding to FIG. 1, again in a changed relative position.

The present illustrative embodiment relates to the wrapping of groups 10 of cigarettes. These are fed in continuously on a packing line 11 at distances from one another and in the longitudinal direction of the cigarettes. The packing line is designed in such a way that the still unpackaged groups 10 of cigarettes are kept in the group formation. For this purpose, the packing line is formed with an upper wall, a lower wall and lateral confines.

The transport of the groups 10 of cigarettes is here effected by a continuous conveyor in the form of a chain conveyor 12. The lugs 13 of the latter enter the packing line 11. For this purpose, the lower wall of the latter is formed with a longitudinal slot for the passage of a peg of the lugs 13.

The group 10 of cigarettes is to be wrapped in a blank 14, specifically in such a way that the blank is laid in the shape of a U around the end face 15 which is in front in the transport direction. Additionally, laterally projecting side flaps of the blank 14 are here prefolded in the zone of the end face 15.

By means of a severing device 17, the blanks 14 are severed from a continuous web 16 of the packaging material. A knife roller 18, equipped with suction bores and subjected to a reduced pressure, transfers the severed blanks 14 to a continuous conveyor in the form of two suction pads 19 and 20 which are located at a distance from one another on a common axis. Along their peripheral surface 21 which takes up the blank 14, these suction pads are provided with suction orifices, namely groups of suction bores 22 and 23*a*, 23*b* or suction slots. A reduced pressure is applied to the latter under a special control in such a way that the blank 14, while being conveyed, is held by the suction pads 19, 20, but is released afterwards, namely on taking up the group 10 of cigarettes.

The suction pads 19, 20 are arranged at such a distance from one another that the group 10 of cigarettes can be passed through between the suction pads 19 and 20. On the side opposite the entry, the blank 14 is held ready in such a way that, in the present case, a central zone of the blank is brought into contact with the end face 15 of the group 10 of cigarettes. As a result of further transport of the group—effected by the chain conveyor 12—the group 10 of cigarettes together with the blank 14 is pushed into a packaging web 24 leading forward. With the upper wall 25 and lower wall 26, this packaging web fixes the blank 14 in the U-shaped arrangement on the group 10 of cigarettes. Additionally, the packaging web 24 is provided with lateral guide means, namely folding bars 27 and 28. These come to bear against the lateral surfaces of the group 10 of cigarettes and, furthermore, have the function of folding the projecting side flap towards the group 10 of cigarettes.

During the crucial phase, the group 10 of cigarettes is taken up in a mouthpiece or receiver 29. In the present case, the latter is formed as a housing which is open at both ends, that is to say with a cover wall 30, bottom wall 31 and side walls 32, 33. The cross-section of the mouthpiece 29 is selected so that the unpackaged group 10 of cigarettes is fixed while maintaining the formation of the cigarettes.

The mouthpiece 29 is displaceably mounted in an exact fit between the suction pads 19 and 20, and specifically in the present case exactly in the central position relative to the suction pads 19, 20. The passage of the mouthpiece 29 runs horizontally, and specifically at the height or as an extension of the packing line 11. The side walls 32, 33 of the mouthpiece 29 are formed with thin walls in order to keep the distance between the group 10 of the cigarettes and the suction pads 19, 20 small.

The group 10 of cigarettes is introduced into the mouthpiece 29 via a rear inlet opening 34 formed like a funnel, specifically by means of the lug 13 of the chain conveyor 12. For this purpose, the bottom wall 31 of the mouthpiece 29 is provided with a slot 35, extending in the longitudinal direction, for the passage of the lugs 13 or their pegs.

The mouthpiece 29 can be moved to and fro in the conveying direction of the group 10 of cigarettes. For this purpose, the mouthpiece 29 is slidingly mounted by means of carrier elements 36 on guide rods 38 which, in the present case, are located laterally outside the packing line 11. The drive of the mouthpiece 29 can be effected by a crank drive.

Even during the movement stroke of the mouthpiece 29, the group 10 of cigarettes is movable relative to the latter in the conveying direction. The movements are here matched in such a way that the mouthpiece 29, moved between the suction pads 19, 20 grips the blank 14, fixed by the suction pads 19, 20, by means of a sharpened front edge 40, while the group 10 of cigarettes is still set back, and draws the blank off the suction pads during the further movement. In FIG. 1, the instant at which the blank 14 is taken up by the front edge 40 of the mouthpiece 29 can be seen.

The transfer of the blank 14 to the group 10 of cigarettes and the U-shaped laying of the wrapping round the latter result from the successive phases in FIGS. 3, 1 and 4. FIG. 3 shows the initial position in which the blank 14 is still in the phase of transport into the end position. The mouthpiece 29 is shown in the retracted position. The take-up by the mouthpiece 29 emerging with the front edge 40 from the zone of the suction pads 19, 20 takes place only after the blank 14 has reached a position, approximately corresponding to that of FIG. 1, relative to the mouthpiece 29 or packing line 11. At the same time, the group 10 of cigarettes has been moved further relative to the mouthpiece 29 in such a way that, a relatively short time after, the blank 14 which has already been preformed in the shape of a U is taken up by the group 10 of cigarettes, emerging from the mouthpiece 29. At this moment, that part of the blank 14 which surrounds the front edge 40 of the mouthpiece 29 has already been introduced into the packaging web 24. The upper wall 25 and lower wall 26 of the latter are provided for this purpose with a sharpened, funnel-shaped inlet edge 41. In the illustrative embodiment shown, the abovementioned inlet edges 41 are located in the immediate vicinity of the periphery of the suction pads 19, 20 so that the mouthpiece 29 executes a stroke between relatively narrow limits. The folding bars 27 and 28, rounded at the free end, are set back relative to the inlet edges 41 in the present case. Alternatively, however, it is also possible to design the folding bars 27, 28 to be movable in such a way that the latter move towards the group 10 of cigarettes together with the blank 14—in the case of a larger distance between the periphery of the suction pads 19, 20 on the one hand and the packaging web 24 on the other hand.

A special control of the fixing of the blank 14 on the suction pads 19 and 20 ensures that, on the one hand, an exact relative position of the blank 14 can be maintained but, on the other hand, the latter can be taken up without inhibitory retaining forces. For this purpose, the suction pads 19, 20 are provided with the first group of suction bores 22—for example a row of suction bores which are mutually adjacent in the axial direction. This group of suction bores is arranged in such a way that in each case a zone, located in front in the transport direction, of the blank 14 is taken up and fixed. The abovementioned suction bores 22 are supplied via a ring main 42 which extends over a wide peripheral zone of the suction pads 19, 20. During this phase, namely until a vent bore 43 is reached, the blank 14 is fixed by the suction bores 22. It is then possible already to release the zone, located in front, on the blank 14 before it reaches the end position and is taken up by the mouthpiece 29, so that the particular part of the blank 14 sags down as shown in FIG. 1.

The two further groups of suction bores 23*a* and 23*b* are arranged at a mutual distance and at a distance from the suction bores 22 in such a way that, when they reach the blank 14, they are located in the position for the transfer to the mouthpiece 29 on either side of the latter (position according to FIG. 1). Accordingly, the blank 14 is fixed immediately on either side of the mouthpiece 29 during the take-up phase by the mouthpiece 29 and the group 10 of cigarettes, and in particular it is fixed only for an instant of the uninterrupted course of motion. The suction bores 23*a*, which are located in front in the direction of revolution, are then in the zone of a further vent bore 44, as a result of which the reduced pressure in the two groups of suction bores 23*a*, 23*b* is diminished, specifically due to a connecting channel 45 between the suction bores 23*a*, 23*b*. Accordingly, the blank 14 is at this moment completely free from retaining forces on the periphery of the suction pads 19, 20.

As can be seen from FIG. 2, the ring main 42 and the vent bores 43 and 44 are formed by air control rings 46 which are stationary and thus secured against rotation and which are pressed by springs 47 against the outer surfaces of the suction pads 19, 20. The suction air is supplied under a reduced pressure via a central suction line 48 in a drive shaft 49 of the suction pads 19, 20 and via connecting lines 50, 51 pointing transversely and radially respectively. The air control rings 46 are fixed on external stationary bearings jambs 53 by means of a stop 52 preventing rotation.

From the ring main 42, air channels 54, 55 and 56, which are parallel to the axis, lead to the suction bores 22 and 23*a*, 23*b* respectively. As can be seen from the drawings, the air channels 54 and 55 for the suction bore 23*a*, 23*b* on the one hand and the air channel 56 for the suction bore 22 on the other hand are located on different (imaginary) circular arcs. The shape of the ring main 42 is correspondingly adapted and, in the zone where the blank 14 is taken up—at the top in FIGS. 1, 3 and 4-is provided with a cross-section which is greater in the radial direction. In this zone, the suction bores 22 and the suction bores 23*a*, 23*b* are supplied through the common ring main 42. Outside the zone of the widened cross-section of the ring main 42, the suction bores 23*a*, 23*b* are separated from the source of reduced pressure.

The severing device 17 is likewise designed in a special way. The continuously revolving knife roller 18 is equipped with two severing knives 57 and 58. The severing knife 57 which protrudes beyond the periphery of the knife roller 18 co-operates with a stationary counter-knife 59. The severing cut for severing the blank 14 from the succeeding web 16 is carried out in this zone.

Relative to the former, the severing knife 58 is set back a little. It co-operates with a correspondingly projecting counter-piece, namely in the present case with a counter-roller 60 which revolves through a support roller 61. The movements of the knife roller 18 and the support roller 61 are matched. The counter-roller 60 which is rotatable by itself protrudes beyond the periphery of the support roller 61, which periphery in turn is at such a distance from the periphery of the knife roller 18 that the projecting severing knife 57 can run past the periphery of the support roller 61 at an adequate distance. The severing knife 58 and counter-roller 60 execute a perforation cut in the blank 14, specifically for delimiting a flap. The relative position is such that the severing cut is carried out initially in the zone of the severing knife 57 and counter-knife 59, and the perforation cut is subsequently carried out in the zone of the severing knife 58 and the counter-roller 60.

In order to transport the web 16 running in or the blank 14 always without creases, speed differences are envisaged. To achieve this, the knife roller 18 revolves at a speed which is somewhat higher than the feeding speed of the web 16. The suction rollers 19, 20 which revolve at equal speed have a somewhat lower speed than the group 10 of cigarettes.

The knife roller 18 is provided with suction bores 62 and 63, the air channels 64 and 65 of which are likewise located at different paths of revolution and are therefore supplied to different extents through a common ring main 66 which is shaped with a non-uniform cross-section. The blanks 14 or the web 16 are fixed only along a relatively small peripheral section—predetermined by a radially inward-pointing widening of the cross-section of the ring main 66—by means of the suction bores 62 which are distributed in a relatively large number along the periphery, whilst an individual group of bores 63 in each case fixes a front zone of the web 16 or the blank 14 from the time it is taken up until it is transferred to the suction pads 19, 20. The end of this holding force is determined by a vent bore 67 formed in the lower zone. The construction and design and the supply of the suction bores 62 and 63 are analogous to those of the suction pads 19, 20.

We claim:

1. A wrapping apparatus for wrapping groups of unpackaged elongated stress-sensitive objects which are conveyed in a forward direction along a longitudinal path, said apparatus comprising:

feeding means for continuously feeding a sheet-like wrapping material downwardly into said path;

cutting means for continuously cutting said material into individual sheets;

said feeding means comprising rotary suction means on the lateral side of said path for gripping the portion of said sheet that is located above and below said longitudinal path before the groups contact the sheet by subjecting the longitudinal marginal portions thereof to frictional suction forces continuously to feed said sheets downwardly into said path, said suction means rotating about an axis perpendicular to said path;

a hollow elongated receiver for receiving each group of objects and disposed in said path, said receiver having an interior cross-section corresponding to that of said group, whereby the shape of said group is maintained;

means for continually conveying said groups through the receiver;

means for imparting longitudinally reciprocating movement to said receiver as said group of objects moves therethrough toward said sheet of wrapping material so that the forward end of said receiver moves against said sheet of wrapping material before each group of objects reaches said forward end, and so that said forward end strips said sheet from said suction means before the forward end of said group reaches said sheet, whereby said sheet is folded in a U-shape around said group and in direct contact therewith as said group continues to move forward, without subjecting said group to the stress of removing said sheet from said suction means; and vent means, responsive to a predetermined rotational position of said rotary suction means, for venting the suction to release said portion of said wrapping material that is located above and below said path right after said receiver and objects move against said sheet and before said sheet is stripped from said suction means by said receiver.

2. A wrapping apparatus as defined in claim 1, further comprising a hollow packaging member for completing the U-folding of said sheet around said group of objects and disposed in said path forward of said sheet of wrapping material, said member having an interior cross-section corresponding to that of said group of objects to maintain the shape of said group, said member having a rear opening sufficiently large to receive the forward end of said receiver upon the forwardmost position thereof.

3. An apparatus according to claims 1 or 2 wherein the forward end of said receiver has front sharp edges.

4. An apparatus according to claims 1 or 2 wherein said conveying means comprises a conveyor chain, and wherein said receiver contains a longitudinal slot for permitting passage of said chain.

5. An apparatus as defined in claims 1 or 2 further comprising first, second and third suction bores connected to a suction source and spaced about the periphery of each of said suction roller means such that said first suction bore first engages each sheet to feed it into said path, and such that said second and third suction bores are disposed on opposite sides of said receiver before said receiver moves against said sheet, and wherein said vent means comprises a plurality of vent bores selectively placed in communication with said suction bores to vent said first suction bore before said receiver moves against said sheet and to vent said second and third suction bores right after said receiver moves against said sheet.

6. An apparatus according to claims 1 or 2 wherein said cutting means comprises a knife roller fitted with first and second severing knives, a stationary counter-knife, and a counter-roller having a variable distance from the periphery of the knife roller, said first severing knife cooperating with said stationary counter-knife for producing a severing cut of said web, said second severing knife cooperating with said counter-roller for producing a perforation cut of said web.

7. An apparatus as defined in claim 6 wherein said cutting means further comprises a revolving support roller upon which said counter-roller is mounted, said counter-roller being mounted in such a way that it protrudes in the radial direction beyond the periphery of the support roller.

8. An apparatus as defined in claim 6 wherein said knife roller comprises suction bore means for retaining said sheet on the surface of said knife roller.

9. A wrapping apparatus for wrapping groups of unpackaged elongated stress-sensitive objects which are conveyed in a forward direction along a longitudinal path, said apparatus comprising:

feeding means for continuously feeding a sheet-like wrapping material downwardly into said path;

cutting means for continuously cutting said material into individual sheets;

said feeding means comprising rotary suction means on the lateral side of said path for gripping the leading end of each sheet and the portion of said sheet that is located above and below said longitudinal path before the groups contact the sheet by subjecting the longitudinal marginal portions thereof to frictional suction forces continuously to feed said sheets downwardly into said path, said suction means rotating about an axis perpendicular to said path;

a hollow elongated receiver for receiving each group of objects and disposed in said path, said receiver having an interior cross-section corresponding to that of said group, whereby the shape of said group is maintained;

means for feeding said groups through the receiver;

means for imparting longitudinally reciprocating movement to said receiver as said group of objects moves therethrough toward said sheet of wrapping material so that the forward end of said receiver moves against said sheet of wrapping material before each group of objects reaches said forward end, and so that said forward end strips said sheet from said suction means before the forward end of said group reaches said sheet, whereby said sheet is folded in a U-shape around said group and in direct contact therewith as said group continues to move forward, without subjecting said group to the stress of removing said sheet from said suction means;

vent means, responsive to a predetermined rotational position of said rotary suction means, for venting the suction and releasing said leading end of said wrapping material before said receiver moves against said sheet and releasing said portion of said wrapping material that is located above and below said path right after said receiver moves against said sheet.

10. A wrapping apparatus as defined in claim 9 further comprising a hollow packaging member for completing the U-folding of said sheet around said group of objects and disposed in said path forward of said sheet of wrapping material, said member having an interior cross-section corresponding to that of said group of objects to maintain the shape of said group, said member having a rear opening sufficiently large to receive the forward end of said receiver upon the forwardmost position thereof.

11. An apparatus according to claims 9 or 10 wherein the forward end of said receiver has front sharp edges.

12. An apparatus according to claims 9 or 10 wherein said means for feeding said groups through the receiver comprises a conveyor chain, and wherein said receiver contains a longitudinal slot for permitting passage of said chain.

13. An apparatus as defined in claims 9 or 10 further comprising first, second and third suction bores connected to a suction source and spaced about the periphery of each of said suction roller means such that said first suction bore first engages each sheet to feed it into said path, and such that said second and third suction bores are disposed on opposite sides of said receiver before said receiver moves against said sheet, and wherein said vent means comprises a plurality of vent bores selectively placed in communication with said suction bores to vent said first suction bore before said receiver moves against said sheet and to vent said second and third suction bores right after said receiver moves against said sheet.

14. An apparatus according to claims 9 or 10 wherein said cutting means comprises a knife roller fitted with first and second severing knives, a stationary counter-knife, and a counter-roller having a variable distance from the periphery of the knife roller, said first severing knife cooperating with said stationary counter-knife for producing a severing cut of said web, said second severing knife cooperating with said counter-roller for producing a perforation cut of said web.

15. An apparatus as defined in claim 14 wherein said cutting means further comprises a revolving support roller upon which said counter-roller is mounted, said counter-roller being mounted in such a way that it protrudes in the radial direction beyond the periphery of the support roller.

16. An apparatus as defined in claim 14 wherein said knife roller comprises suction bore means for retaining said sheet on the surface of said knife roller.

17. A wrapping apparatus for wrapping groups of unpackaged elongated stress-sensitive objects which are conveyed in a forward direction along a longitudinal path, said apparatus comprising:

feeding means for continuously feeding a sheet-like wrapping material downwardly into said path;

cutting means for continuously cutting said material into individual sheets;

said feeding means comprising rotary suction means on either side of said path for gripping each sheet by subjecting the longitudinal marginal portions thereof to frictional suction forces continuously to feed said sheets downwardly into said path, said suction means rotating about an axis perpendicular to said path;

a hollow elongated receiver for receiving each group of objects and disposed in said path, said receiver having an interior cross-section corresponding to that of said group, whereby the shape of said group is maintained;

means for feeding said groups in said forward directions through the receiver;

means for imparting longitudinally reciprocating movement to said receiver as said group of objects moves therethrough toward said sheet of wrapping material so that the forward end of said receiver moves against said sheet of wrapping material before each group of objects reaches said forward end, and so that said forward end strips said sheet from said suction means before the forward end of said group reaches said sheet, whereby said sheet is folded in a U-shape around said group and in direct contact therewith as said group continues to move forward, without subjecting said group to the stress of removing said sheet from said suction means;

first, second and third suction bores connected to a suction source and spaced about the periphery of each of said suction roller means such that said first suction bore first engages each sheet to feed it into said path, and such that said second and third suction bores are disposed on opposite sides of said receiver before said receiver moves against said sheet; and a plurality of vent bores selectively placed in communication with said suction bores to vent said first suction bore before said receiver moves against said sheet and to vent said second and third suction bores right after said receiver moves against said sheet.

18. A wrapping apparatus as defined in claim 17 further comprising a hollow packaging member for completing the U-folding of said sheet around said group of objects and disposed in said path forward of said sheet of wrapping material, said member having an interior cross-section corresponding to that of said group of objects to maintain the shape of said group, said member having a rear opening sufficiently large to receive the forward end of said receiver upon the forwardmost position thereof.

* * * * *